United States Patent [19]

Morse et al.

[11] Patent Number: 4,492,070

[45] Date of Patent: Jan. 8, 1985

[54] CASE LOADING APPARATUS AND METHOD

[76] Inventors: Hugh B. Morse, 1840 Campbell Ave., San Jose, Calif. 95125; Helmut E. Masch, 764 Asbury St., San Jose, Calif. 95126

[21] Appl. No.: 134,703

[22] Filed: Mar. 27, 1980

Related U.S. Application Data

[63] Continuation-in-part of Ser. No. 28,127, Apr. 9, 1979, abandoned.

[51] Int. Cl.[3] ..... B65B 35/50

[52] U.S. Cl. ..... 53/438; 53/447; 53/529; 53/566

[58] Field of Search ..... 53/566, 564, 458, 438, 53/436, 529, 535, 447

[56] References Cited

U.S. PATENT DOCUMENTS

| | | | |
|---|---|---|---|
| 2,249,201 | 7/1941 | Ferguson | 53/566 X |
| 2,631,767 | 3/1953 | Banks | 53/566 X |
| 3,022,615 | 2/1962 | Schroeder et al. | 53/566 X |
| 3,269,091 | 8/1966 | Martin | 53/566 X |
| 3,745,740 | 7/1973 | Williams | 53/535 X |
| 3,941,037 | 3/1976 | Reichert | 53/566 X |

*Primary Examiner*—James F. Coan

[57] ABSTRACT

A case loading apparatus comprises a first conveyor for moving a plurality of articles therealong and a second conveyor for moving open-ended cases therealong. The first conveyor deposits a stacked plurality of the articles on a platen, mounted on an elevator, for movement to a lowered position whereat the articles are transferred to a receptacle. The receptacle is moved adjacent to one of the cases and is inserted therein.

22 Claims, 13 Drawing Figures

FIG. 8
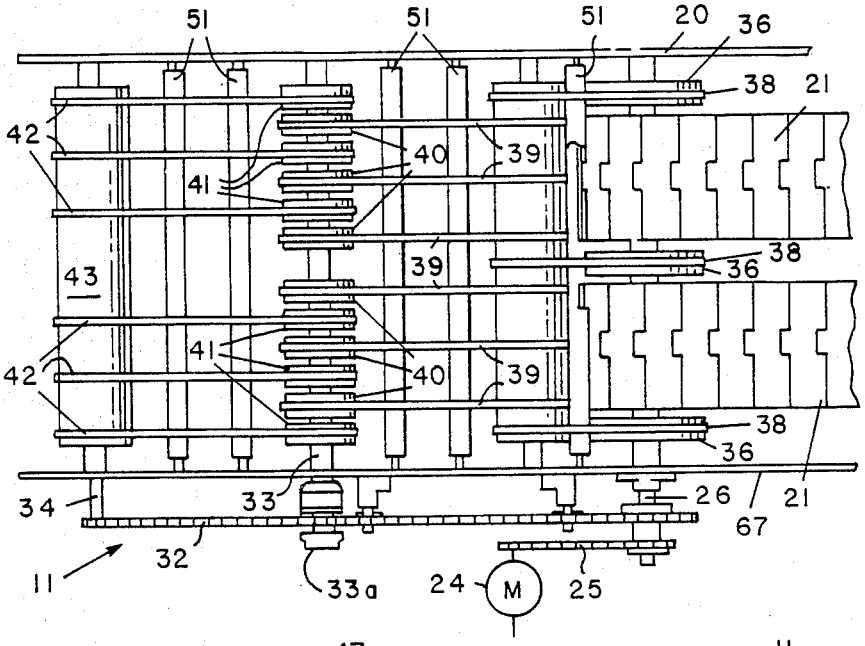
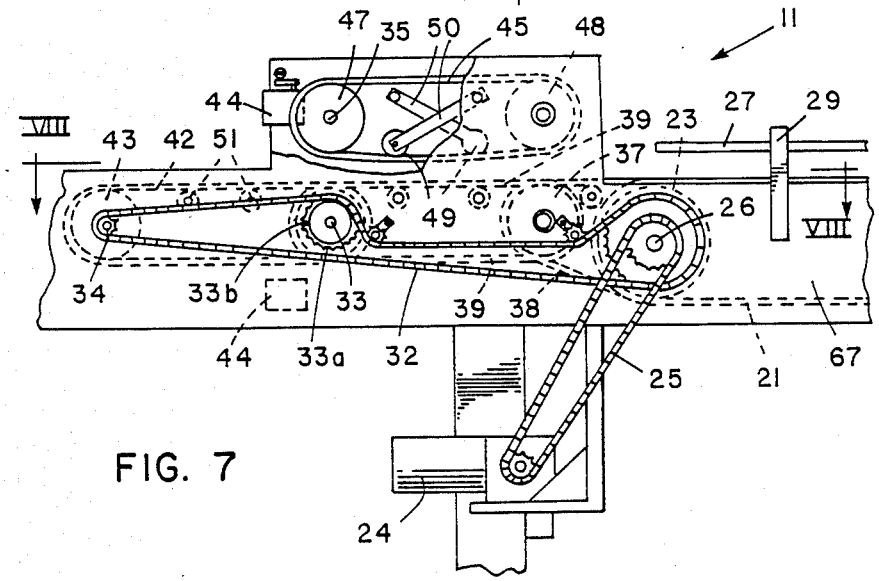
FIG. 7

CASE LOADING APPARATUS AND METHOD

RELATED APPLICATIONS

This application is a continuation-in-part of Ser. No. 06/028,127, filed Apr. 9, 1979, and now abandoned.

BACKGROUND OF THE INVENTION

This invention relates to a case loading apparatus and method wherein a plurality of stacked articles are inserted through an open end of a case which is thereafter sealed.

The loading of cases with articles for shipment purposes is oftentimes accomplished by hand. One approach is to top-load the partially formed case and thereafter secure the cover flap in place at a suitable folding and gluing station of an apparatus. Another approach is to partially form the case in tubular form to define at least one open end thereon and thereafter insert the articles transversely through the open end of the case.

The latter approach has proven preferable in many loading applications, but requires a high degree of dexterity by the worker to precisely position the articles in the case without causing damage thereto. Various prior art apparatus and methods have been proposed to effect the end-loading operation, but are generally unduly complex and do not always ensure the precise positioning of the articles in the case.

The loading problems become even more pronounced when the articles constitute flexible pouches, such as the type of pouches employed to seal frozen vegetables or the like therein. The pouches also contain a trapped volume of air therein which causes the pouches to exhibit non-uniform dimensions. The handling of such packaged foodstuffs not only requires precise positioning thereof for end-loading purposes, but further requires that the apparatus employed to accomplish the same will ensure that no damage occurs to the pouches and contents thereof. For example, any tearing of the pouches would normally cause premature spoilage of such contents.

SUMMARY OF THE INVENTION

The case loading apparatus and method of this invention overcome the above, briefly-described problems by providing for the expeditious and efficient end-loading of a plurality of articles in a case. The apparatus comprises a first conveyor for moving a plurality of articles therealong, a second conveyor for moving a plurality of open-ended cases therealong, an elevator for moving vertically from a first position adjacent to the first conveyor to receive a plurality of stacked articles thereon to a second position below the first conveyor, a receptacle movable from a first position adjacent to the second position of the elevator to a second position adjacent to the second conveyor, a first actuator for moving the stacked articles from the elevator to the receptacle when the elevator is in its second position and the receptacle is in its first position, and a second actuator for moving the stacked articles from the receptacle and into a respective one of the open-ended cases when the receptacle is in its second position.

BRIEF DESCRIPTION OF THE DRAWINGS

Other objects of this invention will become apparent from the following description and accompanying drawings wherein:

FIG. 7 is an enlarged side elevational view, illustrating a second end of the first conveyor and a second conveyor associated therewith;

FIG. 8 is a top plan view, taken in the direction of arrows VIII—VIII in FIG. 7;

DETAILED DESCRIPTION OF THE PREFERRED EMBODIMENT

General Description

Figure 1:
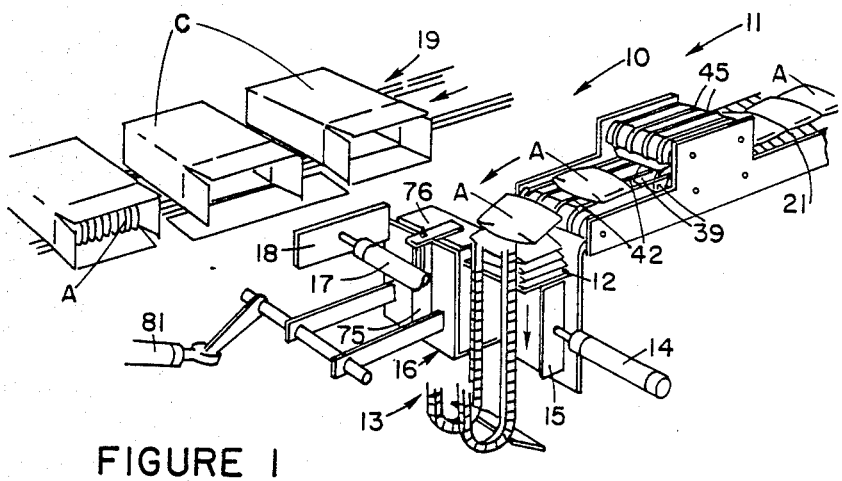
FIG. 1 partially illustrates a case loading apparatus embodying this invention and shown in a first stage of operation.
Figure 2:
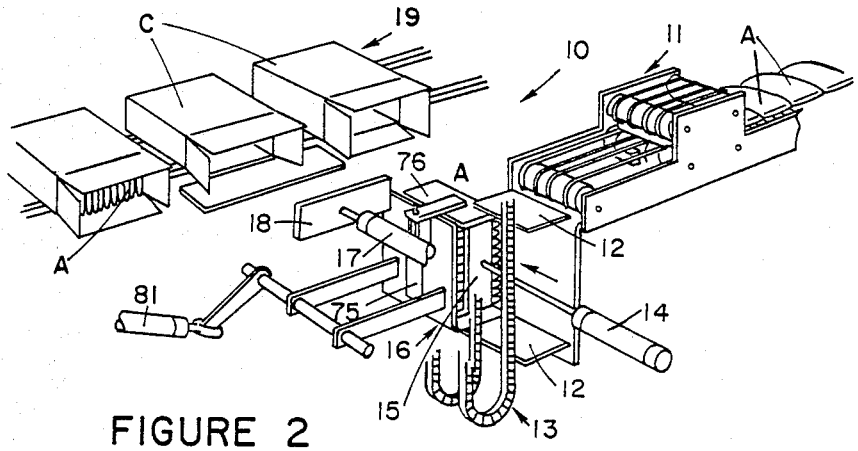
FIGS. 2–4 are views similar to FIG. 1 but sequentially illustrate the case loading apparatus in its second through fourth stages of operation.

FIGS. 1–4 sequentially illustrate operation of a case loading apparatus 10 for inserting a plurality of stacked articles A into an open-end of a case C. The articles may constitute standard flexible pouches having foodstuffs, such as vegetables, sealed therein. Apparatus 10 comprises first conveying means 11 for moving articles A therealong and for depositing a preselected plurality of such articles on a platen 12 of an elevator mechanism 13. As shown in FIGS. 1 and 2, platen 12 is adapted to move vertically from a first position adjacent to conveyor 11 to a second, lowered position, shown in FIG. 2. When platen 12 of elevator 13 is in its second position illustrated in FIG. 2, a first actuator 14 is extended to engage a pusher plate 15 thereof with one side of stacked articles A to move the articles into a receptacle 16.

Figure 3:
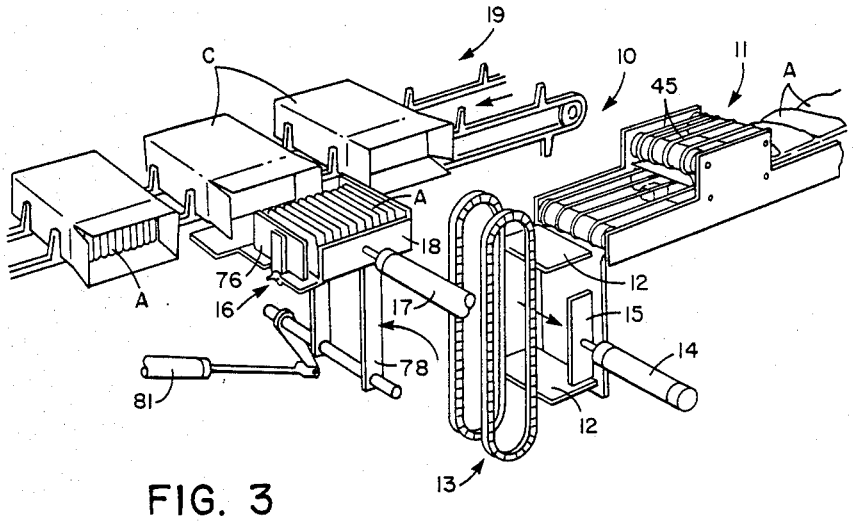
Figure 4:
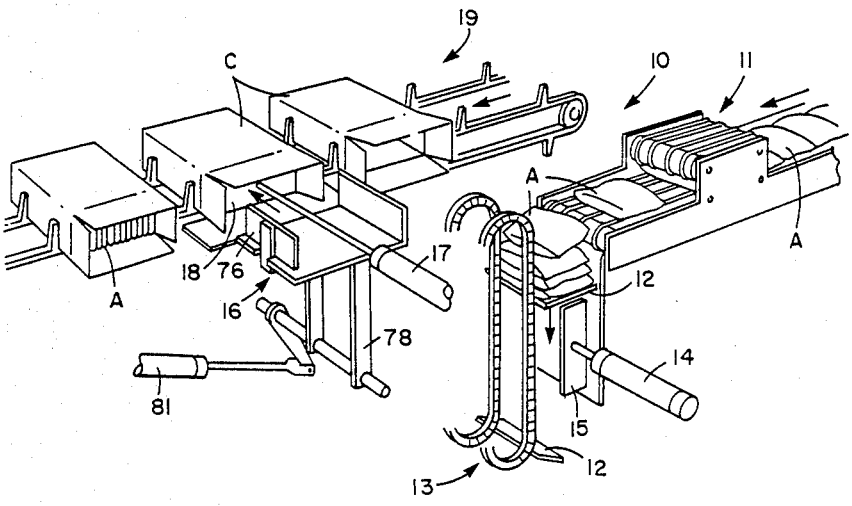

As shown in FIG. 3, receptacle 16 is then rotated 90° to dispose stacked articles A horizontally and align them with the open end of a respective case C whereafter a second actuator 17 is extended. Extension of actuator 17 will engage a pusher plate 18 thereof against one side of stacked articles A to move them within the confines of case C, as shown in FIG. 4. Cases C are mounted in a conventional manner on a second conveyor 19 which then moves the filled case through a standard folding and gluing station (not shown) to close and seal the case for shipment purposes.

Detailed Description

Figures 5, 6:
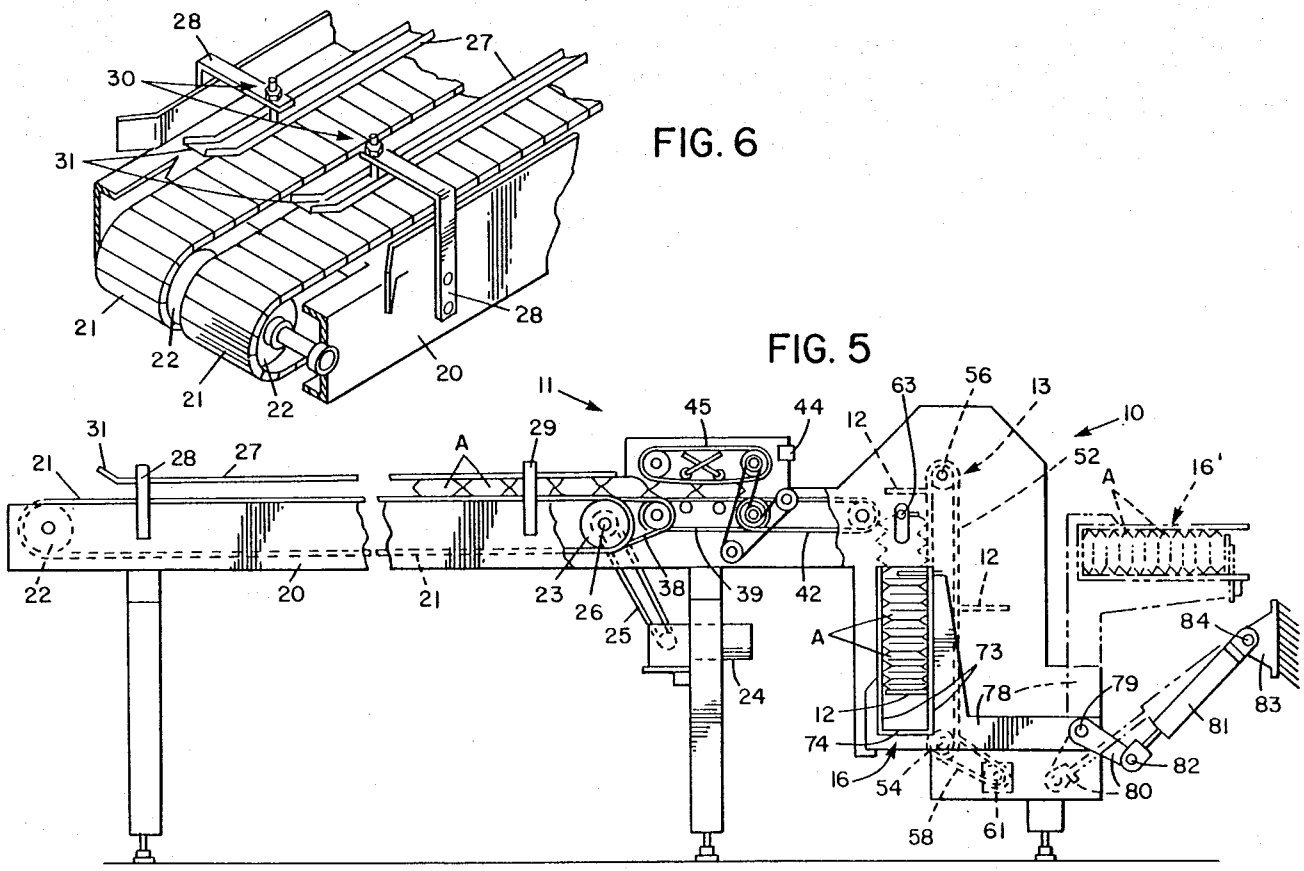
FIG. 5 is a side elevational view of the case loading apparatus.
FIG. 6 is a partial isometric view, illustrating a first end of a first conveyor of the case loading apparatus.

Referring to FIGS. 5–9, first conveyor 11 is mounted on a floor-mounted stationary frame 20. A pair of first endless belts 21 have their ends mounted on longitudinally-spaced idler rollers 22 and drive rollers 23. As shown in FIG. 5, a standard electrical drive motor 24 is suitably connected to an endless chain 25 for driving a shaft 26 having driven rollers 23 (one shown) suitably secured thereon.

A pair of longitudinally disposed and laterally spaced hold-down bars 27 have opposite ends thereof mounted on pairs of brackets 28 and 29, secured to frame 20. Each end of each hold-down bar 27 is mounted on a respective bracket 28 or 29 by a nut and bolt arrangement 30 (FIG. 7) whereby the hold-down bars may be adjusted vertically to accommodate various article thicknesses thereunder. As further shown in FIG. 7, the downstream ends 31 of hold-down bars 27 are flared upwardly to accommodate the reception of articles A thereunder, when they are fed onto belts 21.

Figure 9:
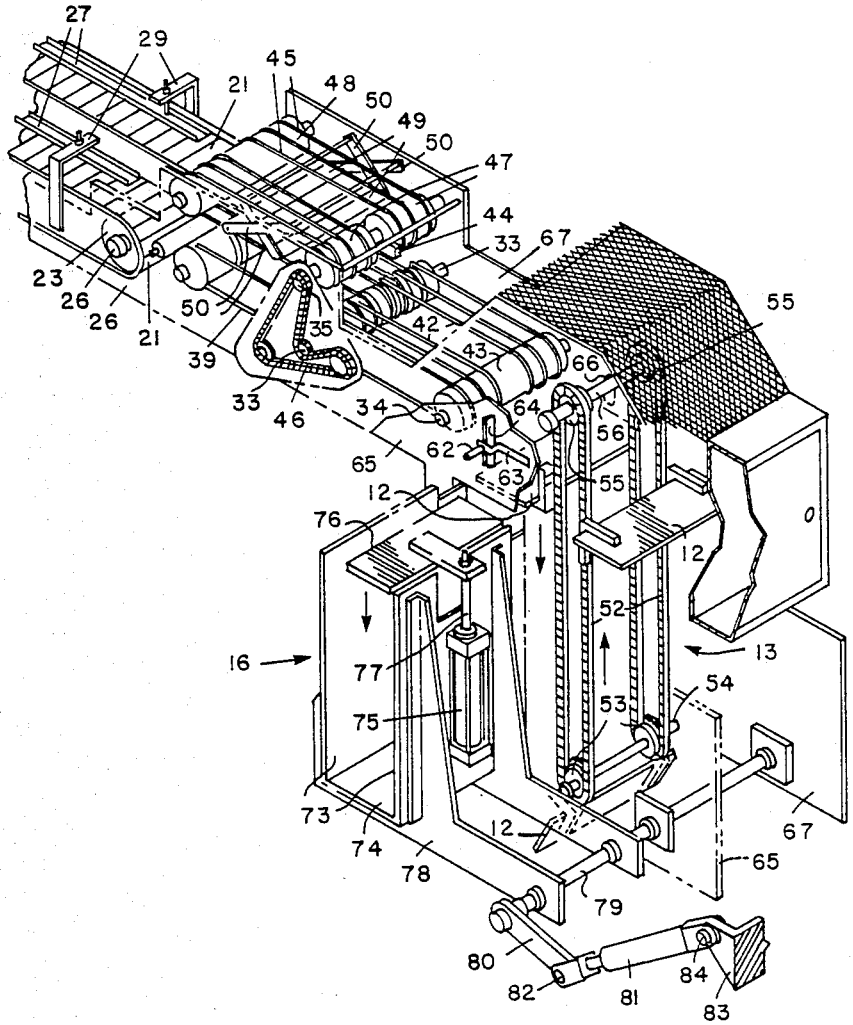
FIG. 9 is an enlarged isometric view with parts broken away for clarification purposes, illustrating a first side of an elevator mechanism and receptacle employed in the case loading apparatus and mounted adjacent to the second conveyor.

Referring to FIGS. 5 and 6–9, first chain 25 is entrained about a motor-driven sprocket and a driven sprocket which is secured to shaft 26 of rollers 23. A second sprocket is secured on shaft 26 to drive a second chain 32 and additional sprockets secured on shafts 33 and 34. Due to the relative drive relationship as between shafts 33 and 34, shaft 34 is driven at approximately twice the speed as shaft 33 for purposes hereinafter explained. Referring to FIG. 9, shaft 33, through suitable sprocket arrangements, drives a shaft 35 for purposes hereinafter explained.

Referring to FIG. 8, three idlers 36 are suitably mounted on shaft 26 by standard bearings (not shown) to freely rotate thereon. An idler roller 37 is rotatably mounted on frame 20 and three rope-like endless transfer belts 38 are mounted on idlers 36 and idler roller 37 to receive articles A thereon to transfer them downstream of belts 21. The articles are then transferred to a plurality of driven endless belts 39, mounted between idler roller 37 and drive rollers 40 secured to shaft 33 for rotation therewith.

A plurality of idlers 41, alternating with drive rollers 40, are suitably mounted on shaft 33 by standard bearings (not shown) to freely rotate thereon. A plurality of driven belts 42 are entrained over idlers 41 and a drive roller 43, secured to shaft 34 to be driven thereby. As suggested above, belts 42 are preferably driven at a linear speed (e.g., 200 fpm) approximately twice the linear speed (e.g., 100 fpm) of belts 39 to ensure that a particular group of articles A inserted into a particular case C are efficiently discharged onto platen 12. In addition, a gap between the articles is created on the upstream side of such group to activate a light induced (emitter/receiver) counter 44 (FIG. 9) to stop belts 39 and a standard clutch-brake 33*a* (FIG. 8) to stop belts 39 and a plurality of complementary overhead belts 45. Belts 38, 39, 42, and 45 and preferably rope-like in construction and composed of a low-friction material, such as polytetrafluoroethelene (Teflon).

Referring to FIG. 9, belts 45 are driven at the same linear speed as underlying belts 39 via shaft 33, a chain 46, shaft 35, and rollers 47 secured on shaft 35. Belts 45 are entrained over rollers 47 and an idler roller 48, rotatably mounted on frame 20. A pair of weighted rollers 49 may be pivotally mounted on frame 20 by links 50 to bear against belts 45 to urge them into frictional and driving engagement with articles A. In addition, a plurality of idler rollers 51 may be rotatably mounted on frame 20 to compensate for any sag which might occur in belts 38, 39 and 42 (FIG. 8).

Figure 10:
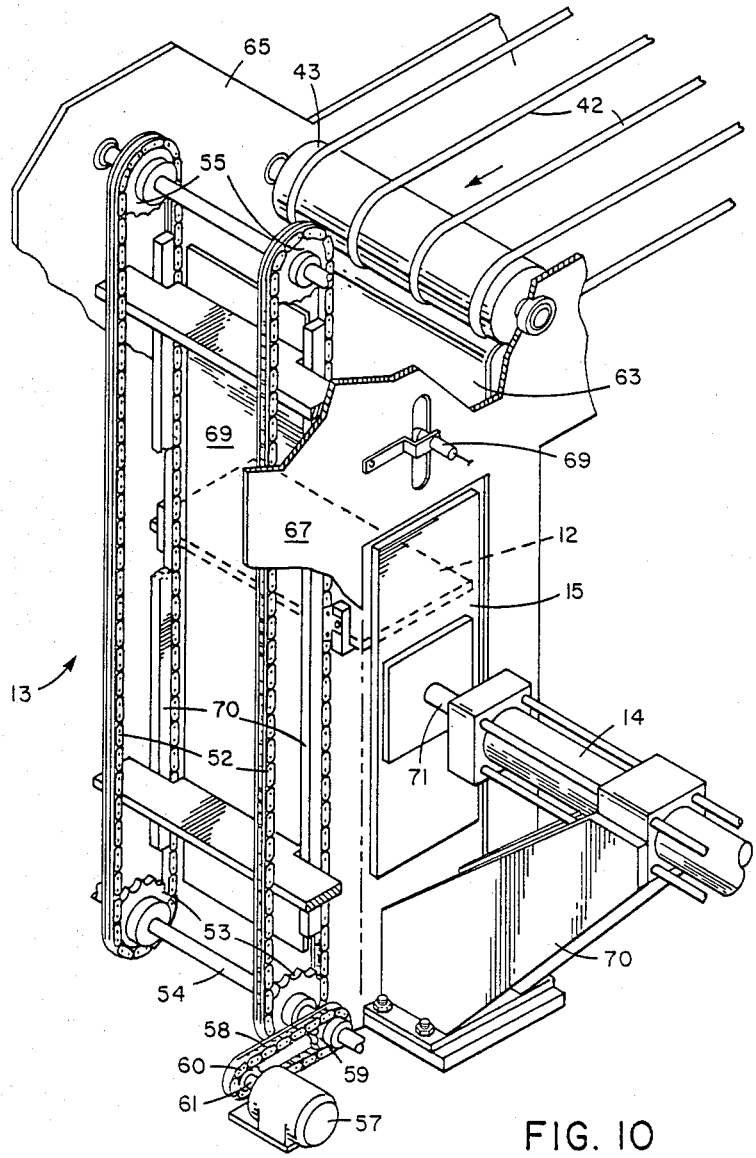
FIG. 10 is an enlarged isometric view, with parts broken away for clarification purposes, illustrating an opposite, second side of the elevator mechanism.

Referring to FIGS. 5, 9, and 10, elevator mechanism 13 is disposed adjacent to the downstream end of conveyor 11 and comprises a pair of endless chains 52 having their lower ends mounted on a pair of sprockets 53 secured on a drive shaft 54 and their upper ends mounted on a pair of sprockets 55 secured on an idler shaft 56. As shown in FIG. 10, drive input to shaft 54 may comprise an electrical motor 57 and an endless chain 58 which is suitably mounted on sprockets 59 and 60 secured to drive shaft 54 and an output shaft 61 of motor 57, respectively. As shown in FIGS. 5 and 9, three platens 12 are suitably secured exteriorly on chain 52 in equally spaced relationship thereon to sequentially move into horizontal disposition adjacent to conveyor 11 for receiving a plurality of articles A thereon.

A standard electric eye 62 is adjustably mounted by a bracket 63 to receive a beam of light through a slot 64 defined through a stationary side plate 65 of frame 20. Likewise, a vertically adjustable light source 66 is mounted on a second laterally spaced side plate 67. Electric eye 62 and light source 66 may be vertically adjusted to detect when the proper number of articles A has been stacked on platen 12, for purposes hereinafter more fully explained. As more clearly shown in FIG. 10, a pair of vertically disposed and spaced stationary plates 68 and 69 are mounted adjacent to conveyor 11 and elevator mechanism 13, respectively, for precisely guiding the disposition of articles A on a particular platen 12 to ensure their proper stacked relationship thereon. In addition, a pair of vertically disposed stationary rails 70 are mounted behind chains 52 to maintain platen 12 in its proper orientation between plates 68 and 69.

As shown in FIG. 2, when platen 12 has been fully loaded with articles A and lowered to a position aligning the articles with receptacle 16, actuator 14 is extended to move the articles into the receptacle. As shown in FIG. 10, actuator 14 preferably comprises a double-acting fluid cylinder mounted on a stationary bracket 70. Pusher plate 15, secured to a reciprocating rod 71 of actuator 14, is adapted to normally be positioned within an accommodating slot 72 formed through stationary plate 67 of frame 20.

Referring to FIGS. 5 and 9, receptacle 16 comprises a pair of parallel side plates 73 and a bottom plate 74 defining a U-shaped cavity in the receptacle. A double-acting fluid cylinder 75 is secured on outer plate 73 and has a compression plate 76 secured on a reciprocating rod 77 thereof. Retraction of cylinder 75 will function to compress plate 76 against stacked articles A, when retained in receptacle 16, to size them for eventual insertion into a respective case C (FIGS. 3 and 4). Compression of articles A is particularly important when such articles constitute plastic pouches or bags which exhibit non-uniform dimensions and require precise compression thereof to adapt them for insertion into the precisely dimensioned cases.

Plates 73 and 74 of receptacle 16 are secured on a member 78 which forms an arm of a bellcrank mechanism for rotating the articles 90° for their proper insertion into a respective case C, as sequentially depicted in FIGS. 2–4. The bellcrank mechanism further comprises a rock shaft 79 which is suitably journaled on stationary plates 65 and 67 and which has member 78 secured thereto. A second arm 80 of the bellcrank mechanism is secured to an end of rock shaft 79 and is pivotally connected to a double-acting fluid cylinder 81 by a pivot pin 82. The head end of cylinder 81 is pivotally mounted on a stationary support 83 by a pin 84 whereby expective extension and retraction of cylinder 81 will function to rotate receptacle 16 between its FIGS. 2 and 3 positions.

When receptacle 16 has been rotated to its FIG. 3 position, to dispose it horizontally and in alignment relative to an open end of a respective case C, cylinder 17 is extended to engage pusher plate 18 with articles A to insert them into the case, as shown in FIGS. 3 and 4. Cylinder 17 may be mounted on frame 20 of the apparatus in any well known manner. As is further well known to those skilled in the arts relating hereto, the various motors and cylinders, as well as counter 44 and electric eye 62, are suitably integrated into a control system for synchronizing the operations thereof. For example, it should be noted in FIG. 4 that upon insertion of a first plurality of articles A into a case C, a second group of articles are being simultaneously and automatically deposited onto a platen 12. Since the specific type of integrated control system, per se, does not form part of the invention disclosed and claimed herein, further explanation thereon is not deemed necessary to an understanding of such invention.

Method of Operation

Referring to FIG. 1, a conventional magazine (not shown) is mounted at the upstream end of conveyor 19 to retain flattened cases C thereon. Suction cups or the like may be employed in association with the magazine to open each case and deposit it onto conveyor 19. Simultaneously therewith, articles A are deposited onto belts of conveyor 11 by conventional means or by hand. Apparatus 10 is particularly adapted for the loading of articles in package or pouch form, into cases C.

One problem with such sealed pouches, which may contain foodstuffs such as frozen vegetables or the like, is that they exhibit non-uniform dimensions and forms due to the flexibility of the pouches and the air trapped therein. Conventional apparatus and methods, including hand-loading methods, experience difficulty in the expeditious and precise loading of such pouches in a case. The following described method compensates for such dimensional discrepancies in the pouches and provides for the expeditious and efficient loading thereof into cases C without causing damage to the pouches.

Referring to FIGS. 1 and 5, conveyor belts 21 feed articles A between belts 39 and 45 at a linear speed approximating 100 fpm, for example. Belts 21, 39 and 45 are driven at substantially the same linear speed. The articles are then conveyed onto belts 42 which are preferably driven at a speed substantially higher than the speed of the aforementioned belts, such as 200 fpm. The increased speed of the latter belts is utilized primarily to positively discharge articles A off belts 42 and onto platen 12 and to also expose counter 44 when a gap is created between the last article of a first stack of articles discharged onto the platen and the next trailing article which would be the lead article for the next or second stack of articles. Counter 44 is operatively connected to a standard clutch-brake **33*a* (FIG. 8) whereby the clutch-brake is disengaged when the counter records the predetermined number of stacked articles to be discharged onto platen 12** and loaded into a respective case C.

Disengagement of clutch-brake **33*a* will stop belts 39 and 45 to momentarily prevent any additional articles from being conveyed to belts 42, until a second platen 12 is positioned to receive the same. In particular, actuation of clutch-brake 33*a* in response to counter 44 will disengage a sprocket 33*b* from shaft 33 (FIGS. 7 and 8) whereby the sprocket will free-wheel on the shaft. Since shaft 33 normally drives a chain 46 (FIG. 9) for further driving a shaft 35 and drive rollers 47, both sets of belts 39 and 45** will stop.

As sequentially shown in FIGS. 1 and 2, once the predetermined stack of articles A is deposited onto platen 12, the platen will have been moved downwardly by intermittently operated chains 52 and stops to align the articles with receptacle 16. Cylinder 14 then extends automatically to engage pusher plate 15 thereof with the articles to move them into the confines or receptacle 16.

As shown in FIG. 3, cylinder 14 then retracts and cylinder 81 is extended to rotate receptacle 16 approximately 90° from a vertical to a horizontal disposition to align the articles with the open end of a respective case C. Cylinder 17 is then extended to engage pusher plate 18 thereof with the articles to move them into the confines of case C. Prior to the latter step, cylinder 75 is retracted a predetermined amount to compress articles A together to a predetermined longitudinal dimension to compensate for any irregularities in the dimensions of the articles or pouches, as described above.

When the articles have been moved into a respective case C, as shown in FIG. 4, cylinder 17 retracts whereby the above method steps are repeated automatically. As shown in FIG. 4, clutch-brake **33*a* (FIG. 8) is reengaged and a second stack of articles are deposited onto a second platen 62 simultaneously with the movement of the first stack of articles into a case C by cylinder 17. Upon retraction of cylinder 17, intermittently driven conveyor 19 will move the filled cases through a standard folding and gluing station (not shown) wherein the end closure flaps of the case are closed and sealed. If so desired, an apparatus similar to apparatus 10 may be mounted on the opposite side of conveyor 19** whereby each apparatus will load an alternate case C.

Figure 11A:
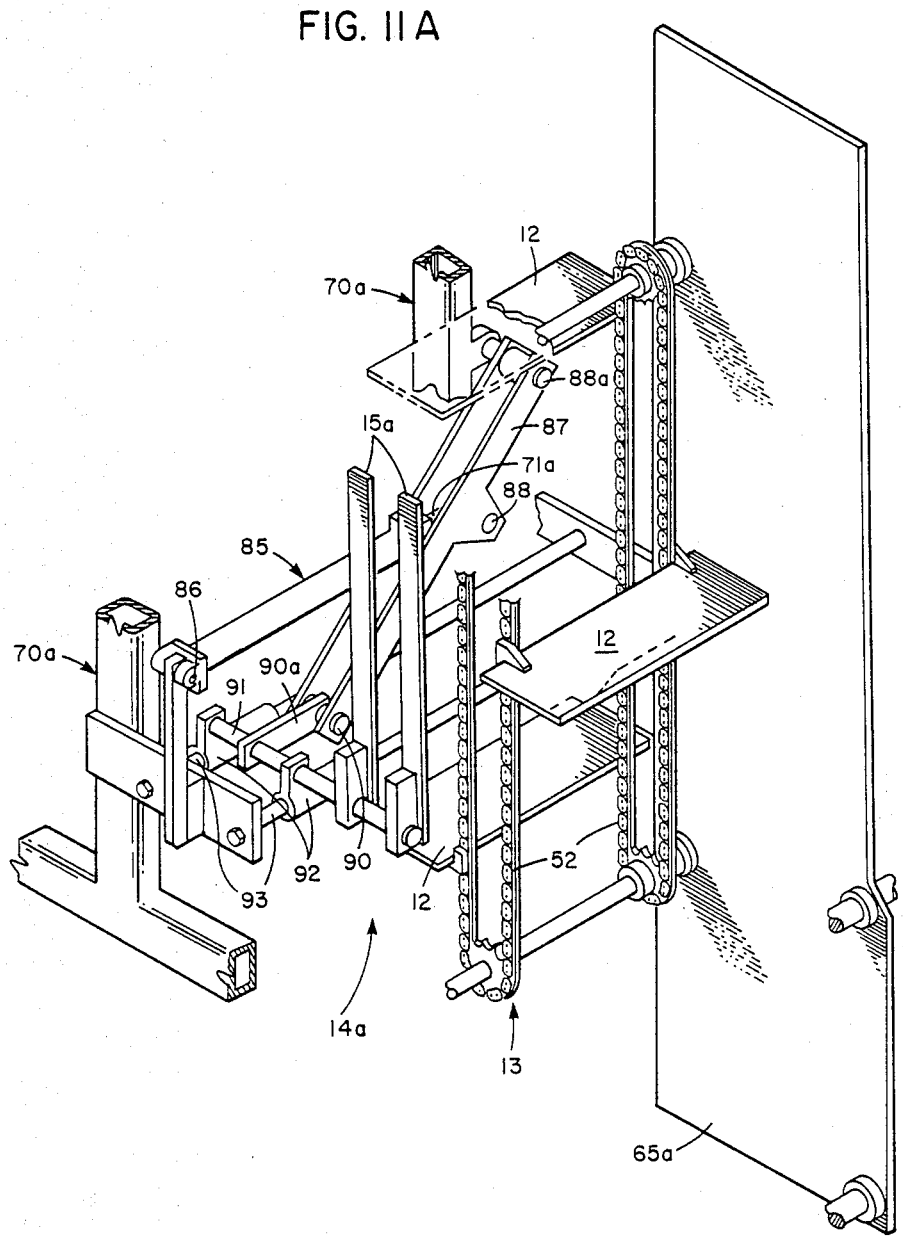
FIGS. 11A–11C are isometric views illustrating a modified pusher mechanism and receptacle.
Figure 11B:
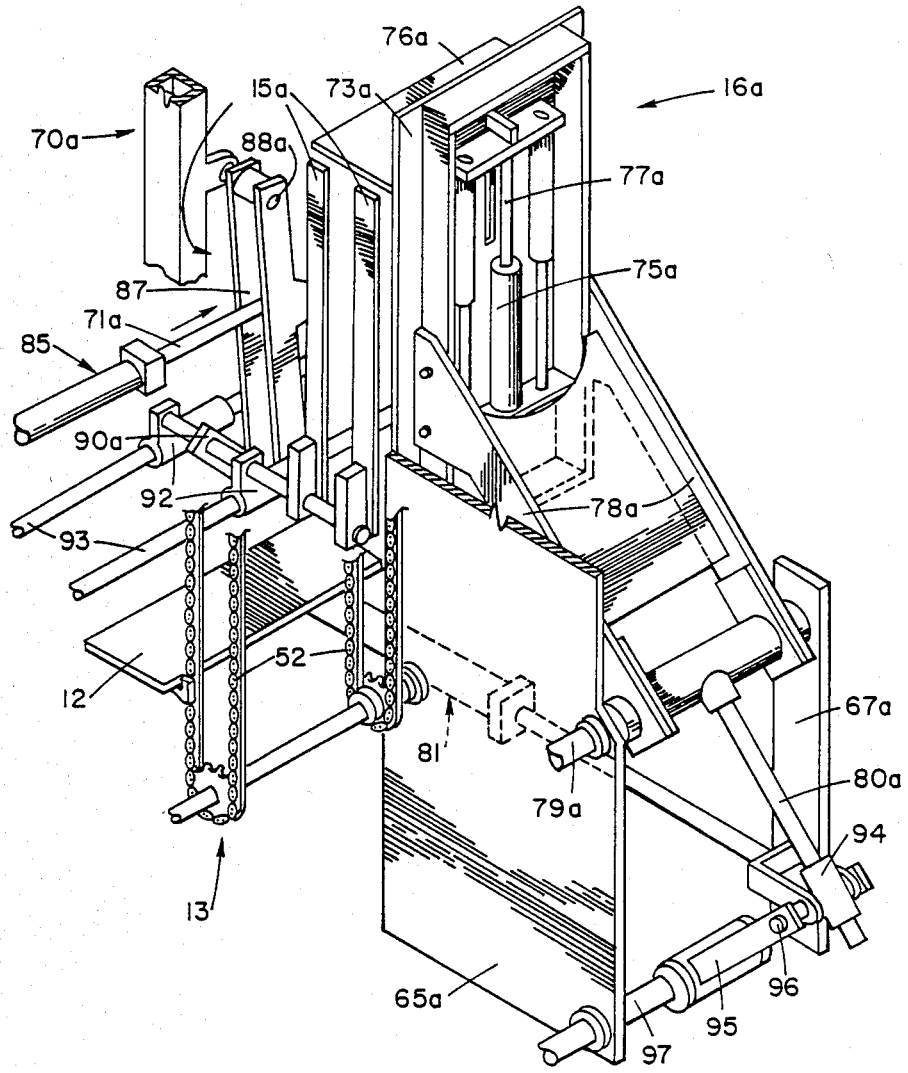
Figure 11C:
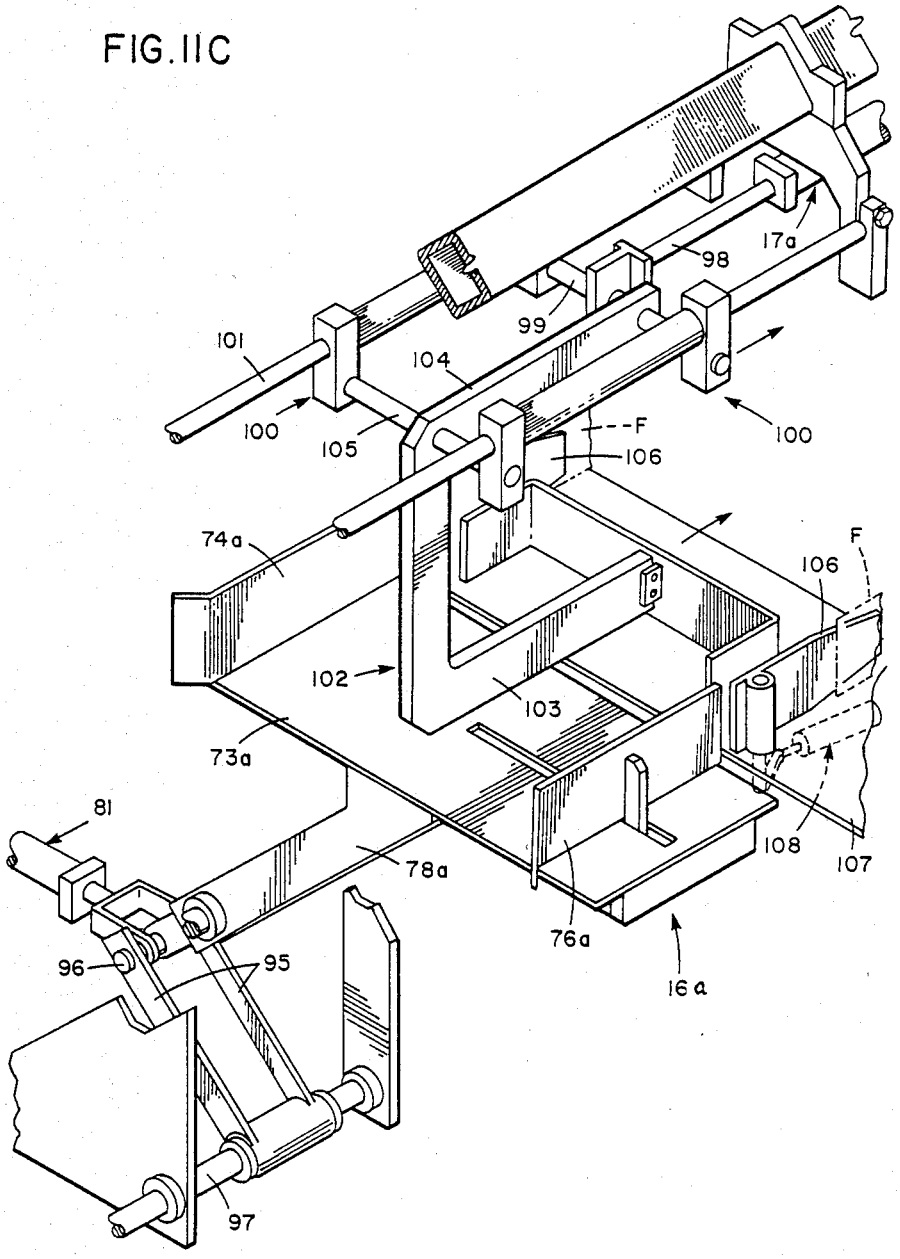

FIGS. 11A–11C illustrate a modified pusher mechanism **14*a* for elevator 13 for depositing articles from the elevator into a modified receptacle 16*a*. Numerals depicting corresponding, but modified constructions in FIGS. 11A–11C** are accompanied by an "a".

Modified pusher mechanism **14*a* comprises a stationary bracket 70*a* and an actuator in the form of a double-acting fluid cylinder 85 having a head end thereof pivotally mounted on the bracket by a pivot pin 86. A cylinder rod 71*a* is pivotally mounted to a lever 87 by a pin 88 with an upper end of the lever being pivotally mounted on bracket 70*a* by a pin 88*a*. A lower end of lever 87 is pivotally mounted on a link 90*a* by a pin 90 with the opposite end of the link being pivotally mounted on a cross-bar 91. The first end of cross-bar 91 is secured to a pair of pusher plates 15*a* which correspond to pusher plate 15 in FIG. 10**.

The opposite, second end of the bar, pivotally mounting link **90*a* thereon, is secured to a pair of bearing sleeves 92 reciprocally mounted on a pair of stationary guide rods 93 secured to bracket 70*a*. Referring to the sequence of operation illustrated in FIGS. 11A and 11B, it can be seen that extension of cylinder 85 will pivot lever 87 about pivot pin 88*a* to shift pusher plates 15*a* forwardly between a pair of vertically spaced platens 12 of intermittently operated elevator 13 for loading articles A into receptacle 16**, in generally the same manner as described above.

As further described above, the extension and retraction of cylinder 85 is suitably timed in relation to the intermittent operation of chains 52 of elevator 13, as well as the alignment of receptacle 16a, for receiving the articles therein prior to rotation of the receptacle approximately 90° to align it with a respective case C (FIG. 4) for case-loading purposes. As shown in FIGS. 11B and 11C, receptacle 16a comprises at least one side plate 73a (a parallel pair thereof may be utilized, if so desired) and a bottom plate 74a secured to the side plate to define a cavity in the receptacle for receiving a plurality of stacked articles therein. A double-acting fluid cylinder 75a has its casing secured to plate 73a and has a compression plate 76a secured to a reciprocating rod 77a thereof. Retraction of cylinder 75a will function to compress plate 76a against the stacked articles, when retained in receptacle 16a, to size them for eventual insertion into a respective case C (FIGS. 3 and 4).

Receptacle 16a is secured to a pair of spaced arms 78a which form part of a bellcrank mechanism for rotating receptacle 16a 90° to its FIG. 11C position for proper insertion of the articles into a respective case. The arms are mounted for pivotal movement on a rock shaft 79a which is suitably journaled on a pair of stationary plates 65a and 67a and a rod 80a is suitably secured to arms 78a for simultaneous movement therewith. Rod 80a is slidably mounted in a bearing sleeve 94 which is pivotally mounted on a pair of spaced lever arms 95 by a pin 96. Lever arms 95 are pivotally mounted on a shaft 97, mounted between plates 65a and 67a, and a rod of cylinder 81 is pivotally mounted on pin 96. It can thus be seen in the sequence of operation (FIGS. 11B and 11C) that retraction of cylinder 81 will pivot lever arms 95 generally counterclockwise in FIG. 11B to thus pivot rod 80a and arms 78a generally clockwise to position receptacle 16a generally horizontally, as shown in FIG. 11C.

When receptacle 16a has been so positioned to align articles A with an open end of a respective case C (FIG. 3), a double-acting fluid cylinder 17a is retracted to engage a pusher plate thereof with the articles to insert them into the case, as shown in FIGS. 4 and 11C. Cylinder 17a is suitably mounted on frame 20 of the apparatus, and a rod 98 thereof is suitably attached to a cross-rod 99, as shown in FIG. 11C. Rod 99 is, in turn, secured to a pair of laterally spaced sleeve bearing assemblies 100 which are slidably mounted on stationary rods 101. A C-shaped member 102 has one leg 103 secured to the pusher plate and another leg 104 thereof secured to rod 99 and another rod 105, also secured between bearing assemblies 100.

With this arrangement, it can be seen in FIG. 11C that retraction of cylinder 17a will slide sleeve bearing assemblies 100 generally rightwardly therein on rods 101 to thus move the pusher plate rightwardly to load the articles from receptacles 16a and into a case. FIG. 11C further illustrates a pair of flipper-type gates 106 which are pivotally mounted adjacent to a horizontally disposed stationary platen 107 for opening to permit pusher plate 18a to pass therethrough for case-loading purposes, and to guide the articles into the case. A double-acting fluid cylinder 108 may be suitably connected to each gate 106 to pivot the gates between their illustrated open positions and closed positions whereby they are pivoted 90° inwardly towards each other and into alignment with an inboard side of platen 107. Gates 106 will further function to maintain laterally spaced flaps F of the carton open in non-interfering relationship with the articles when they are inserted into the carton.

What is claimed is:

1. A case loading apparatus comprising:

first conveyor means for moving a plurality of articles therealong, second conveyor means mounted adjacent to said first conveyor means for moving a plurality of open-ended cases therealong, elevator means, including an endless chain having a plurality of platens secured thereon, for directly moving vertically and intermittently from a first position closely adjacent to said first conveyor means to receive a plurality of stacked articles thereon to a second position below said first conveyor means, receptacle means for moving from a generally vertical first position adjacent to the second position of said elevator means to a generally horizontal second position adjacent to said second conveyor means, first actuating means for moving between a space defined between an adjacent and vertically spaced pair of said platens to move said stacked articles from said elevator means to said receptacle means when said elevator means is in its second position and said receptacle means is in its generally vertical first position, and second actuating means for moving said stacked articles from said receptacle means into a respective one of said open-ended cases when said receptacle means is in its generally horizontal second position.

2. The apparatus of claim 1 wherein said first conveyor means comprises first belt means for receiving and moving said articles thereon.

3. The apparatus of claim 2 further comprising hold-down means mounted vertically above said first belt means for holding said articles thereon.

4. The apparatus of claim 2 wherein said first conveyor means further comprises second belt means disposed in linear alignment with respect to said first belt means for receiving said articles from said first belt means, said second belt means comprising a plurality of first belts aligned linearly with said first belt means and second belts disposed vertically above said first belts, said first and second belts having the same linear speed.

5. The apparatus of claim 4 wherein each of said first and second belts has a construction composed of a low-friction material.

6. The apparatus of claim 4 wherein said first conveyor means further comprises third belt means for receiving articles from said second belt means and wherein said third belt means has a linear speed substantially greater than the speeds of said first and second belt means.

7. The apparatus of claim 1 wherein said platens are secured exteriorly on said endless chain in equally spaced relationship thereon.

8. The apparatus of claim 7 wherein said first actuating means comprises a double-acting fluid cylinder having a pusher plate for movement from a retracted position to an extended position between a pair of said platens for moving said stacked articles off said platen and into said receptacle means.

9. The apparatus of claim 1 further comprising means for compressing said stacked articles within said receptacle means.

10. The apparatus of claim 9 wherein said receptacle means comprises a bottom plate and at least one side plate to define a receptacle and wherein said means for compressing said stacked articles is mounted on said side plate.

11. The apparatus of claim 10 wherein said means for compressing said stacked articles comprises a double-acting fluid cylinder mounted on said side plate and a compression plate disposed in parallel relationship relative to said bottom plate.

12. The apparatus of claim 1 wherein said receptacle means comprises a receptacle and further comprising third actuating means connected to said receptacle for rotating said receptacle to align said stacked articles with an open end of a respective one of said cases.

13. The apparatus of claim 12 wherein said third actuating means comprises a double-acting fluid cylinder and a bellcrank connecting said cylinder to said receptacle.

14. The apparatus of claim 12 wherein said third actuating means is connected to said receptacle for pivoting said receptacle 90°.

15. The apparatus of claim 1 wherein said second actuating means comprises a double-acting fluid cylinder having a pusher plate secured on a rod end thereof.

16. A method for end-loading a case with a plurality of stacked articles comprising the steps of conveying said articles in a first direction, intermittently moving a plurality of platens in an endless path, stacking a predetermined pluarlity of articles on a said platen while simultaneously lowering said platen, stopping said platens while simultaneously pushing said articles off said platen and into a generally vertically disposed receptacle, moving said receptacle generally horizontally to align said stacked articles with an open end of a case, and pushing said articles from said receptacle and into the open end of said case.

17. The method of claim 16 wherein said conveying step comprises the steps of first conveying said articles at a first linear speed and second conveying a plurality of said articles at a second linear speed which is substantially higher than said first speed.

18. The method of claim 16 further comprising the step of counting said predetermined plurality of stacked articles and preventing further articles from being conveyed after such count.

19. The method of claim 16 further comprising the step of compressing said articles in said receptacle to define a predetermined composite dimension thereof.

20. The method of claim 16 wherein said moving step comprises the step of pivoting said receptacle with said plurality of stacked articles retained therein.

21. The method of claim 20 wherein said pivoting step comprises the step of pivoting said receptacle and the plurality of stacked articles retained therein through an arc of approximately 90°.

22. The method of claim 21 wherein said pivoting step includes the step of pivoting said receptacle and the stacked articles retained therein from said generally vertically disposed disposition to said generally horizontally disposed disposition.

* * * * *